US010691072B1

(12) United States Patent
Johnson

(10) Patent No.: US 10,691,072 B1
(45) Date of Patent: Jun. 23, 2020

(54) IDENTIFICATION OF BANDS FOR WEARABLE ELECTRONIC DEVICES

(71) Applicant: Apple Inc., Cupertino, CA (US)

(72) Inventor: Timothy M. Johnson, San Jose, CA (US)

(73) Assignee: Apple Inc., Cupertino, CA (US)

( * ) Notice: Subject to any disclaimer, the term of this patent is extended or adjusted under 35 U.S.C. 154(b) by 68 days.

(21) Appl. No.: 15/849,520

(22) Filed: Dec. 20, 2017

Related U.S. Application Data

(60) Provisional application No. 62/556,753, filed on Sep. 11, 2017.

(51) Int. Cl.
*G04B 37/14* (2006.01)
*G04B 47/06* (2006.01)

(52) U.S. Cl.
CPC ..... *G04B 37/1486* (2013.01); *G04B 47/06* (2013.01)

(58) Field of Classification Search
CPC .. A44C 5/007; A44C 5/0015; G04B 37/1486; G04B 47/06; G04B 47/063
See application file for complete search history.

(56) References Cited

U.S. PATENT DOCUMENTS 8,725,842 B1 5/2014 Al-Nasser
2003/0013947 A1* 1/2003 Frattarola ..... A61B 5/14532 600/322
2016/0262028 A1* 9/2016 Reddy ..... G06F 1/1698
2017/0027461 A1* 2/2017 Shin ..... A61B 5/00
2017/0084133 A1* 3/2017 Cardinali ..... G04G 21/00
2017/0160819 A1* 6/2017 Yi ..... G06F 3/0416
2017/0303646 A1* 10/2017 Bricken ..... G06F 1/1652
2017/0331505 A1* 11/2017 Shim ..... H04B 1/385
2017/0357426 A1* 12/2017 Wilson ..... G06F 3/0482
2018/0000205 A1* 1/2018 Chinowsky ..... F21V 33/0008
2018/0059714 A1* 3/2018 Martin ..... A61B 5/015
2018/0157217 A1* 6/2018 Song ..... G04G 21/06
2018/0279965 A1* 10/2018 Pandit ..... A61B 5/6826

* cited by examiner

*Primary Examiner* — Daniel P Wicklund
(74) *Attorney, Agent, or Firm* — Morgan, Lewis & Bockius LLP

(57) ABSTRACT

A wearable device can include an electronic device and a band for securing the electronic device to the user. The electronic device can detect an identification of the band, which can serve as an input to initiate actions performed by the electronic device. For example, a type, model, color, size, or other characteristic of a band can be determined and used to select a corresponding action performed by the electronic device. Identification of the band can be performed by components of the electronic device that also serve other purposes. Existing sensors, communication elements, and/or detectors can be used to detect and identity a band provided to the electronic device. The electronic device can respond to the identification of a particular band by performing particular functions, such as changing an aspect of a user interface or altering settings of the electronic device.

15 Claims, 8 Drawing Sheets

IDENTIFICATION OF BANDS FOR WEARABLE ELECTRONIC DEVICES

CROSS-REFERENCE TO RELATED APPLICATION

This application claims the benefit of U.S. Provisional Application No. 62/556,753, entitled "IDENTIFICATION OF BANDS FOR WEARABLE ELECTRONIC DEVICES," filed Sep. 11, 2017, the entirety of which is incorporated herein by reference.

FIELD

The described embodiments relate generally to wearable electronic devices. More particularly, the present embodiments relate to identification of bands for wearable electronic devices and corresponding actions based on the identification.

BACKGROUND

Portable electronic devices have become increasingly popular, and the features and functionality provided by portable electronic devices continue to expand to meet the needs and expectations of many consumers. With some wearable electronic devices, the component parts are modular and exchangeable. For example, electronic wristwatches can allow a user to select one of a variety of bands for securing the electronic components to the user. The user can select and exchange bands based on a preference for certain characteristics of a given band.

However, some traditional portable electronic devices, particularly wearable electronic devices, may have relatively limited functionality or are only able to perform a specialized set of functions or tasks. Some portable electronic devices operate without regard to the band selected for use therewith. The embodiments described herein are directed to a wearable device that provides a wide range of functionality that can be influenced by selection of a band.

BRIEF DESCRIPTION OF THE DRAWINGS

The disclosure will be readily understood by the following detailed description in conjunction with the accompanying drawings, wherein like reference numerals designate like structural elements, and in which.

Figure 1:
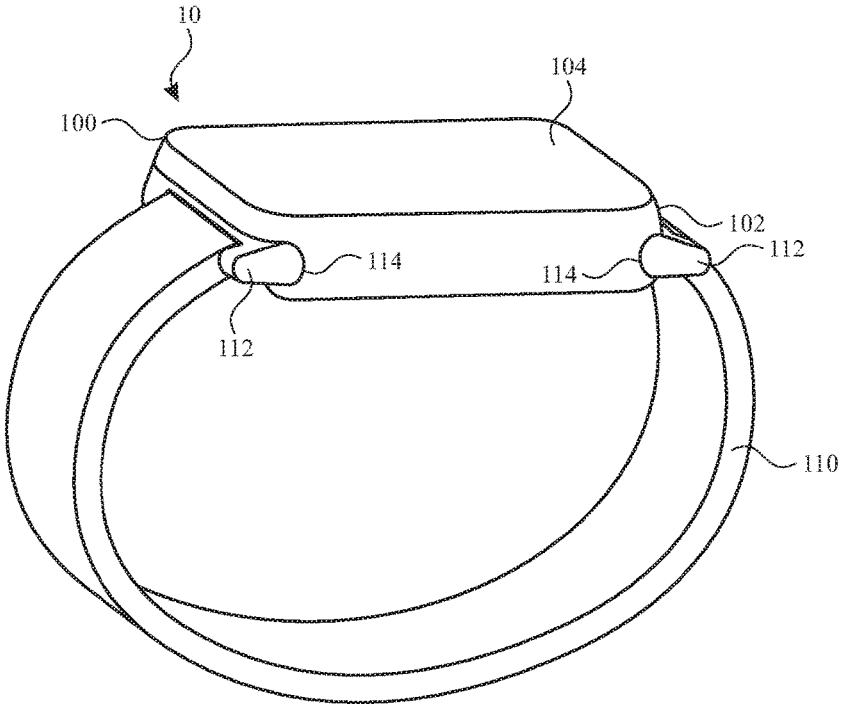
FIG. 1 illustrates a perspective view of an exemplary wearable device.

In one or more implementations, not all of the depicted components in each figure may be required, and one or more implementations may include additional components not shown in a figure. Variations in the arrangement and type of the components may be made without departing from the scope of the subject disclosure. Additional components, different components, or fewer components may be utilized within the scope of the subject disclosure.

DETAILED DESCRIPTION

The detailed description set forth below is intended as a description of various implementations and is not intended to represent the only implementations in which the subject technology may be practiced. As those skilled in the art would realize, the described implementations may be modified in various different ways, all without departing from the scope of the present disclosure. Accordingly, the drawings and description are to be regarded as illustrative in nature and not restrictive.

The following disclosure relates to identification of a band for use with an electronic device. The identification can serve as an input to initiate actions performed by the electronic device. For example, a type, model, color, size, or other characteristic of a band can be determined and used to select a corresponding action performed by the electronic device.

A wearable device can include an electronic device and a band for securing the electronic device to the user. In many traditional devices, the electronic device does not interact with or even identify the band that is used in conjunction with the electronic device. In other devices, the band may provide certain functionality to supplement the functionality of the electronic device. However, such bands often require a power source, such as from an integrated battery or from the battery of the electronic device. Furthermore, such bands often require a robust communication link with the electronic device for bidirectional communication. These features impose significant design considerations that increase the cost and complexity of the parts.

In contrast to traditional devices, the band identification capabilities described herein provide simple and elegant solutions that allow an electronic device to readily identify a band. In some embodiments of the present disclosure, identification of the band can be achieved by a variety of mechanisms. For example, identification of the band can be performed by components of the electronic device that also serve other purposes. Existing sensors, communication elements, and/or detectors can be used to detect and identity a band provided to the electronic device. Accordingly, identification of a band with the electronic device can be achieved without adding dedicated components to the electronic device. Furthermore, identification can be achieved without sacrificing power to the band and without requiring a bidirectional communication link with the band.

A selection of a certain band can influence operation of the electronic device in a variety of ways. For example, the electronic device can respond to the identification of a particular band by performing particular functions, such as changing an aspect of a user interface or altering settings of the electronic device. Such functions can be readily executed by the electronic device upon identification of the band, such that user input is not required. Accordingly, a user's experience with the electronic device can be enhanced based on the user's selection of a particular band.

These and other embodiments are discussed below with reference to FIGS. 1-11. However, those skilled in the art will readily appreciate that the detailed description given herein with respect to these figures is for explanatory purposes only and should not be construed as limiting.

FIG. 1 illustrates a perspective view of an exemplary wearable device 10. The wearable device 10 can include an electronic device 100 and a band 110. As shown, the electronic device 100 includes a housing 102 that supports a display 104. The electronic device 100 can be worn on a user's wrist and secured thereto by the band 110. The band 110 includes lugs 112 at opposing ends of the band that fit within respective recesses or channels 114 of the housing 102 and allow the band 110 to be removably attached to the housing 102. The lugs 112 may be part of the band 110 or may be separable (and/or separate) from the band 110. Generally, the lugs 112 may lock into the channels 114 and thereby maintain connection between the band 110 and the housing 102. The user may release a locking mechanism (not shown) to permit the lugs 112 to slide or otherwise move out of the channels 114. In some wearable devices, the channels 114 may be formed in the band 110 and the lugs may be affixed or incorporated into the housing 102. While lugs 112 and channels 114 are illustrated, it will be recognized that other attachment elements, such as locks, snaps, clasps, threads, and pins can be included on the band 110 for securely attaching to the electronic device 100.

Figure 2:
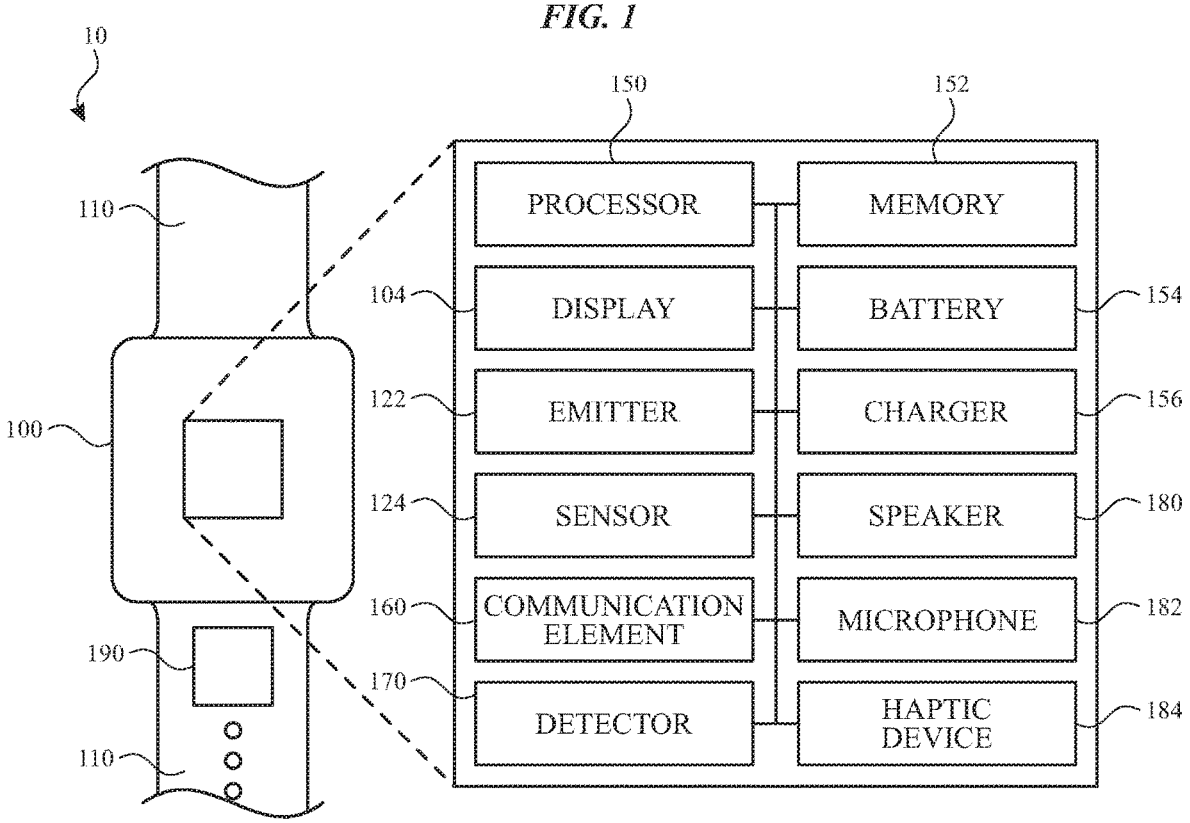
FIG. 2 illustrates a simplified system diagram of an exemplary wearable device.

As shown in FIG. 2, the band 110 can include an identification element 190 that is detectable by one or more components of the electronic device 100. Features of the identification element 190 can be selected to achieve detection by the electronic device 100, as described further herein. For example, the identification element 190 can include a feature on a surface of the band 110 and/or be embedded within the structure of the band 110. The identification element 190 can be positioned on or along any portion of the band 110 to facilitate detection. For example, the identification element 190 can be located near an end of the band 110 (e.g., at or near a lug 112). Alternatively or in combination, the identification element 190 can be located on a side of the wearable device 10 that is opposite the electronic device 100. The identification element 190 can be used to determine information about the band 110, such as a type, characteristic, feature, or identity of the band 110. Subsequent actions by the electronic device 100 can correspond to the determined information.

As further shown in FIG. 2, the electronic device 100 can include components that support the operations thereof. Such operations can include identification of a band 110, actions based on the identification, and other operations that are independent of the identification. In some embodiments, components used for operations independent of the identification of the band 110 can also be used for identification. Such components are described below with reference to FIG. 2.

In some embodiments, as shown in FIG. 2, the electronic device 100 includes a processor 150, memory 152, a power source 154, and/or a charger 156 for providing power to the power source 154.

The processor 150 can control or coordinate some or all of the operations of the electronic device 100. The processor 150 can communicate, either directly or indirectly with substantially all of the components of the electronic device 100. For example, a system bus or signal line or other communication mechanisms can provide communication between the processor 150, the memory 152, the power source 154, as well as other components. The processor 150 can be implemented as any electronic device capable of processing, receiving, or transmitting data or instructions. As described herein, the term "processor" is meant to encompass a single processor or processing unit, multiple processors, multiple processing units, or other suitably configured computing element or elements.

The memory 152 can store electronic data that can be used by the electronic device 100. For example, a memory can store electrical data or content such as, for example, audio and video files, documents and applications, device settings and user preferences, timing and control signals or data for the haptic device 184, data structures or databases, and so on. The memory 152 can be configured as any type of memory. By way of example only, the memory can be implemented as random access memory, read-only memory, Flash memory, removable memory, or other types of storage elements, or combinations of such devices.

A power source 154 can be implemented with any device capable of providing energy to the electronic device 100. For example, the power source 154 can be a battery and/or a connection cable that connects the charger 156 to another power source such as a wall outlet. In other examples, wireless power can be used.

In some embodiments, as shown in FIG. 2, the electronic device 100 can include components for interacting with a user. In some embodiments, the electronic device 100 includes a display 104, a speaker 180, a microphone 182, and/or a haptic device 184.

The display 104 may provide an image or video output for the electronic device 100. The display 104 may also provide an input surface for one or more input devices such as a touch sensing device, force sensing device, temperature sensing device, and/or a fingerprint sensor. The display 104 may be any size suitable for inclusion at least partially within the housing 102 of the electronic device 100 and may be positioned substantially anywhere on the electronic device 100. Other input devices can be provided for operation by a user. For example, one or more buttons, dials, crowns, switches, or other devices can be provided for receiving input from a user.

The haptic device 184 can be implemented as any suitable device configured to provide force feedback, vibratory feedback, tactile sensations, and the like. For example, in one embodiment, the haptic device 184 may be implemented as a linear actuator configured to provide a punctuated haptic feedback, such as a tap or a knock.

In some embodiments, as shown in FIG. 2, the electronic device 100 can include components that facilitate detection of an identification element 190, among other functions. In some embodiments, the electronic device 100 includes a light source 122, a biosensor 124 (e.g., biometric sensors, environmental sensors, etc.), a communication element 160, and/or a detector 170. As used herein, "a sensor" can include or be operably connected to any component that is capable of facilitating detection of an identification element 190. A sensor can include or be operably connected to the biosensor 124, the communication element 160, and/or the detector 170. As described herein, components of the electronic device 100 can be used as sensors for detection of an identification element 190, yet also have other functions apart from detection of the identification element 190.

The communication element 160 can facilitate transmission of data to or from other electronic devices across standardized or proprietary protocols. For example, a communication element 160 can transmit electronic signals via a wireless and/or wired network connection. Examples of wireless and wired network connections include, but are not limited to, cellular, Wi-Fi, Bluetooth, infrared, RFID and Ethernet. The communication element 160 can communicate with or sense the band 110 or another device, as described further herein.

The electronic device 100 may also include one or more biosensors 124 positioned substantially anywhere on the electronic device 100. The biosensor or biosensors 124 may be configured to sense substantially any type of characteristic such as, but not limited to, images, pressure, light, touch, force, temperature, position, motion, and so on. For example, the sensor(s) 124 may be a photodetector, a temperature sensor, a light or optical sensor, an atmospheric pressure sensor, a humidity sensor, a magnet, a gyroscope, an accelerometer, and so on. In other examples, the electronic device 100 may include one or more health sensors. In some examples, the health sensors can be disposed on a bottom surface of the housing of the electronic device 100, as discussed further herein. Other sensors or detectors 170 can be provided with similar or different functionality.

Figure 3:
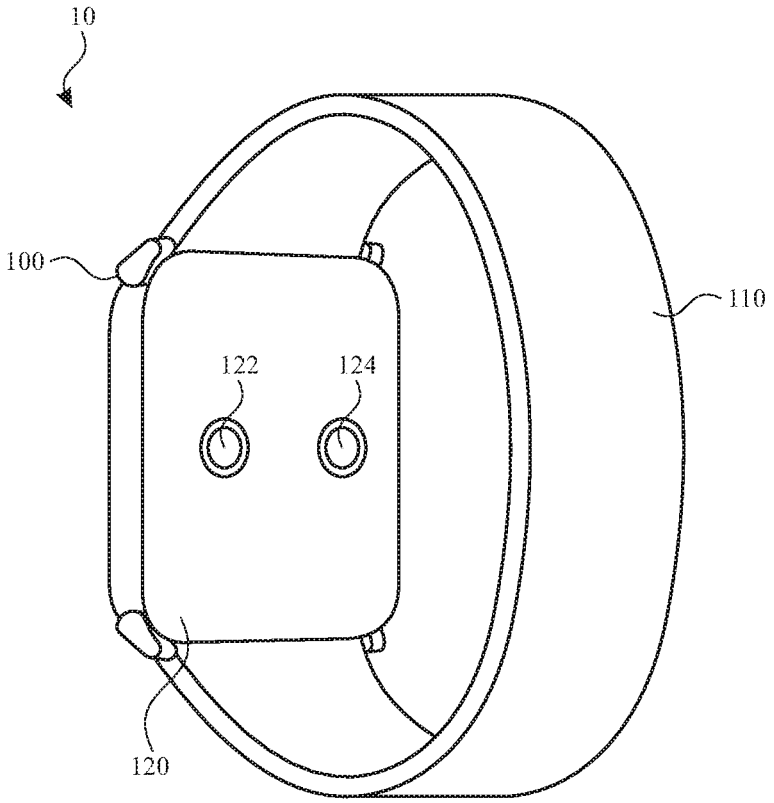
FIG. 3 illustrates a perspective view of an exemplary wearable device.
Figure 4:
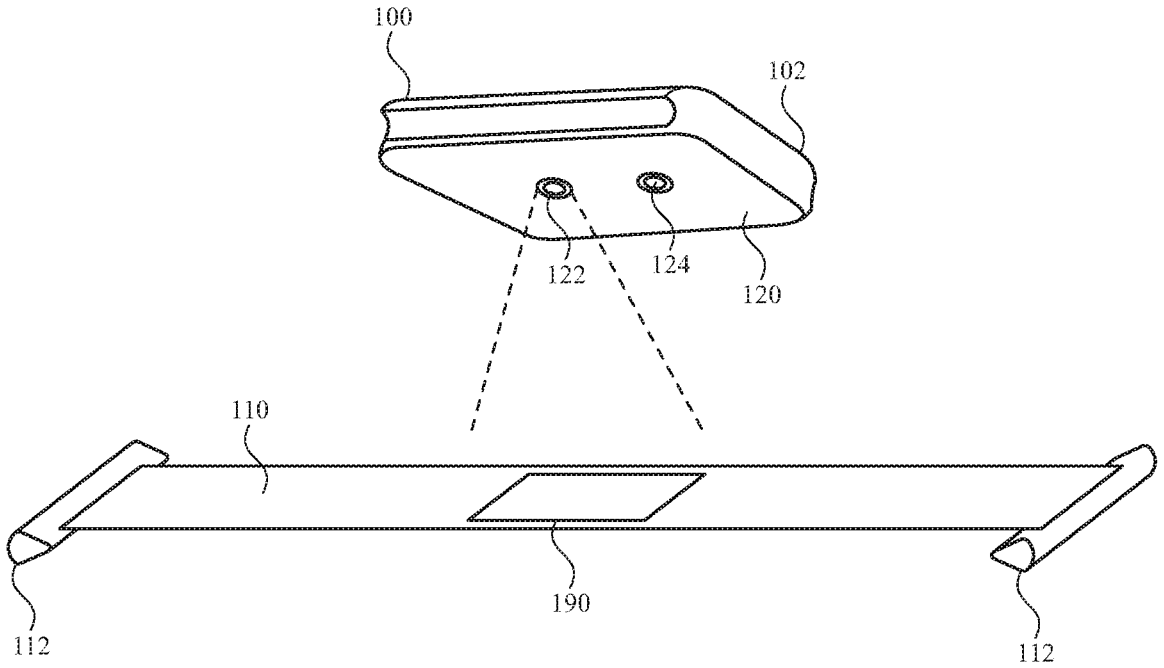
FIG. 4 illustrates a perspective view of the exemplary wearable device of FIG. 3 during a detection operation.

Referring now to FIGS. 3 and 4, the wearable device 10 can detect an identification element 190 of a band 110 by operating components that also perform other, independent functions. For example, the electronic device 100 can include one or more biosensors and may include optical and/or electronic biometric sensors that may be used to compute one or more health metrics. As shown in FIG. 3, the electronic device 100 can include a light source 122 and a biosensor 124, such as a photodetector, that are exposed on a bottom surface 120 of the housing 102 to form a photoplethysmography ("PPG") sensor. In some cases, a PPG sensor may be configured to detect changes in blood volume based on reflected light, and one or more physiological parameters of the user may be determined by analyzing the reflected light. The optical (e.g., PPG) sensor or sensors may be used to compute various health metrics including, without limitation, a heart rate, a respiration rate, blood oxygenation level, a blood volume estimate, blood pressure, or a combination thereof. The light source 122 can emit, for example, visible (e.g., green) light, which may be adapted for detecting blood perfusion in the body of the wearer. The light source 122 can emit, for example, infrared light, which may be adapted to detect changes in water content or other properties of the body. Other types of light sources and colors can be used, depending on the sensing configuration. Multiple light sources 122 may operate at the same light wavelength value or range, or the light sources 122 can operate at different light wavelength values or ranges. One or more lenses can be aligned with components of the PPG sensor to magnify, amplify, or otherwise enhance the ability of the sensor to capture such data.

As shown in FIG. 4, the components of the PPG sensor can also be used to detect an identification element 190 of the band 110. In some embodiments, the band 110 can be positioned so that the identification element 190 is within a light path of the light source 122 and within a field of view of the biosensor 124. Light emitted from the light source 122 can be reflected off of the identification element 190. For example, the identification element 190 can include a pattern on the band 110 that reflects the wavelength(s) of light emitted from the light source 122. As discussed above, the light can be infrared light, visible (e.g., green) light, or another wavelength value or range. Where the identification element 190 reflects light outside of the visible spectrum, it can be non-visible to a user. For example, the identification element 190 can include ultraviolet-reflective ink. As such, the identification element 190 can provide identification capabilities without being noticeable by a user.

In some embodiments, the identification element 190 is a symbol, such as a barcode, including a machine-readable representation of information in the form of one or more patterns. The symbol may be formed as patterns of dark (e.g., black) and light (e.g., white) bars, circles, dots or other shapes. Other patterns are contemplated, such as patterns of dots, concentric circles and the like. Other examples of barcodes include Universal Product Codes (UPCs), Code 39 barcodes, Code 128 barcodes, PDF417 barcodes, EZcode barcodes, DataMatrix barcodes, QR Codebarcodes, or barcodes that utilize any other type of barcode symbology. A 1D sensor or a 2D sensor can be used to capture images of adequate resolution (e.g., pixels) to detect the identification element 190 (e.g., barcode). With some sensors, such as a PPG sensor, the barcode can be scanned by swiping the barcode in front of the sensor. The depth of focus of the sensor can be arranged so that the barcode is in focus when the band is swiped past the sensor.

The biosensor 124 can be configured to perform barcode scanning. In particular, the biosensor 124 and/or other components of the electronic device 100 can capture an image of the identification element 190 and use digital image processing techniques to decode the barcode. During a detection operation, the electronic device 100 may prompt a user to line up the biosensor 124 with the identification element 190 in a particular manner, such as aligning the identification element 190 in the center of an image captured by the biosensor 124 and displayed on the display 104.

In some embodiments, the biosensor 124 can directly detect an intrinsic characteristic of a band 110. For example, various bands 110 can be of different materials, constructions, textures, and/or colors. The biosensor 124 can distinguish one or more characteristics of a given band 110 from those of another band 110. The biosensor 124 can optically detect certain characteristics, such as color and reflectivity, of a band 110 and identify the band 110 based on whether it satisfies expected criteria relating to the detected characteristics. For example, the biosensor 124 can distinguish the color and reflectivity of a stainless steel band from the color and reflectivity of a brown leather band. Thereby, the electronic device 100 can identify each of the bands 110 and perform corresponding actions.

While the band 110 is shown in FIG. 4 as separated from the electronic device 100 during a detection operation, it will be recognized that the band 110 can be connected to the electronic device 100 during a detection operation. For example, the identification element 190 can be positioned on the band 110 such that, when the band 110 is connected to the electronic device 100, the identification element 190 is within a light path of the light source 122 and within a field of view of the biosensor 124.

In some embodiments, the biosensor 124 can be another type of biosensor. For example, the biosensor 124 can be configured to perform an electrical measurement using one or more electrodes. The electrical sensor(s) may be used to measure electrocardiographic (ECG) characteristics, galvanic skin resistance, and other electrical properties of the user's body. Additionally or alternatively, the biosensor 124 can be configured to measure body temperature, exposure to UV radiation, and other health-related information. In addition to the above-referenced biosensor capabilities, the same biosensor 124 can be used to detect the identification element 190 of the band 110. For example, the identification element 190 can be brought into contact with the biosensor 124. The identification element 190 of a given band 110 can provide an electrical interaction with the biosensor 124 that is distinguishable from that of another identification element 190 of a different band 110. The electrical interaction can include communication via an established protocol or transmission of a signal that is unique to the given band 110. Thereby, the electronic device 100 can identify each of the bands 110 and perform corresponding actions.

Figure 5:
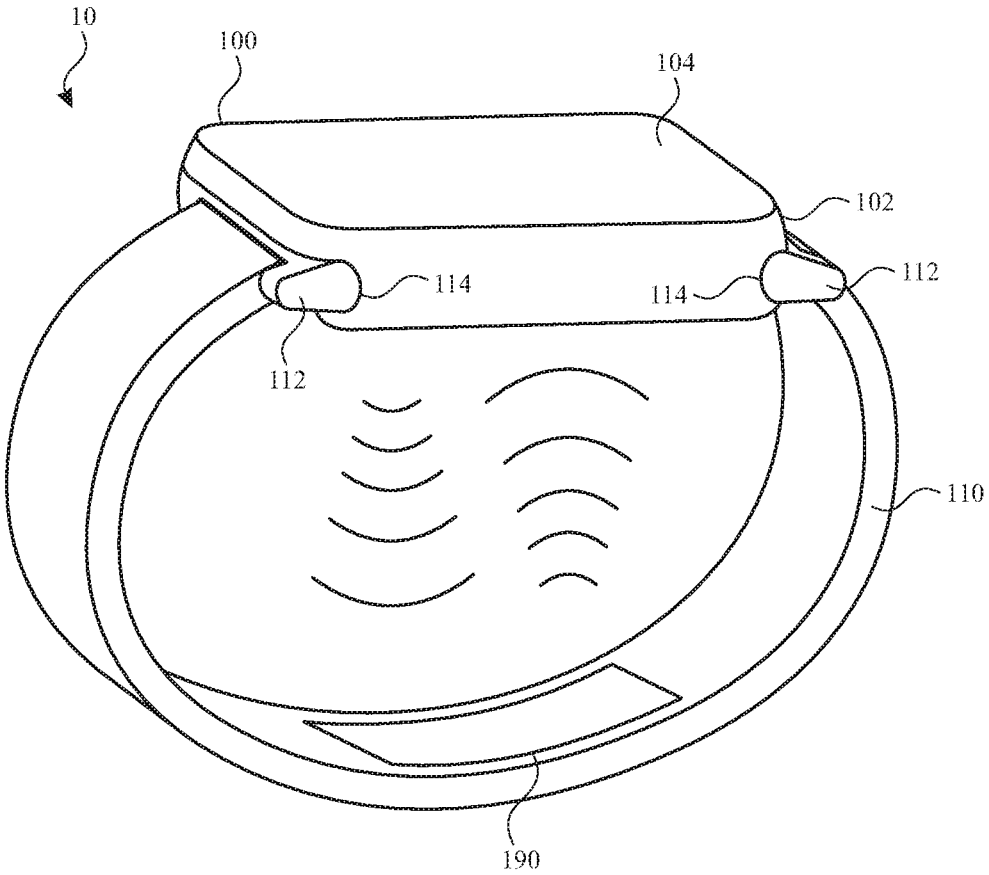
FIG. 5 illustrates a perspective view of an exemplary wearable device during a detection operation.

Referring now to FIG. 5, the electronic device 100 can detect an identification element 190 of a band 110 by using a sensor that applies a communication protocol. Wireless or wired communication can be performed, at least in part, by a sensor such as the communication element 160 (not shown in FIG. 5) of the electronic device 100. Communication between the identification element 190 and the electronic device 100 can employ a short-range communication method, such as near field communication ("NFC"), radio-frequency identification ("RFID"), Bluetooth, Wi-Fi, Wi-Fi Direct, short-range 802.11, and high frequency focused beams such as 60 GHz. Alternatively or additionally, communication between the identification element 190 and the electronic device 100 can employ a high frequency communication method, such as WirelessHD, WiGig, and Wi-Fi IEEE 802.11ad.

As shown in FIG. 5, the electronic device 100 can be placed near the band 110. The electronic device 100 and the band 110 can include a wireless system that is configured to enable one-way or two-way communications. The one- or two-way communication may include an identification of the band 110 and the electronic device 100 to initiate a data connection between the two devices. The user initiates a communication between the electronic device 100 and the band 110 by placing the electronic device 100 near the identification element 190 (e.g., a tag). In some embodiments, the electronic device 100 is configured to automatically detect the presence of the identification element 190 and initiate an identification process or routine. The system may include a unique identifier or signature that may be used to authenticate the identity of the band 110.

Figure 6:
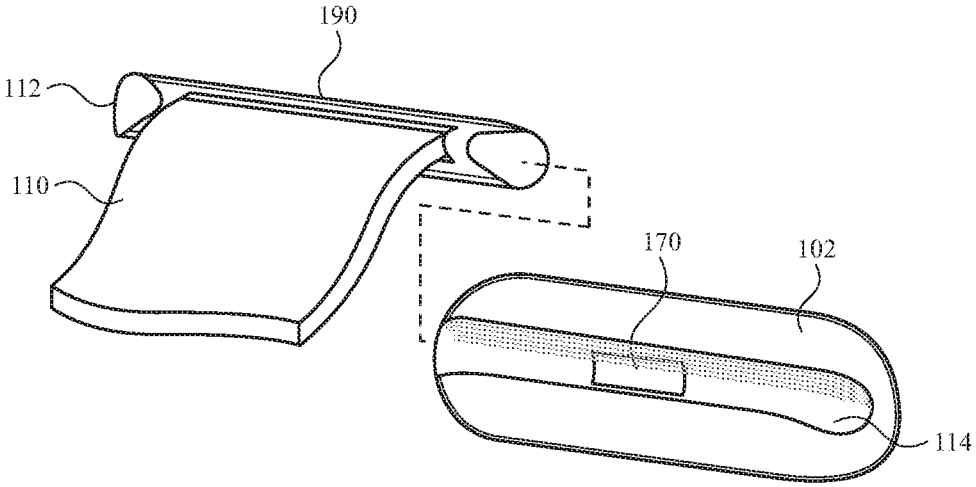
FIG. 6 illustrates a perspective view of an exemplary wearable device prior to insertion of a band into an electronic device.
Figure 7:
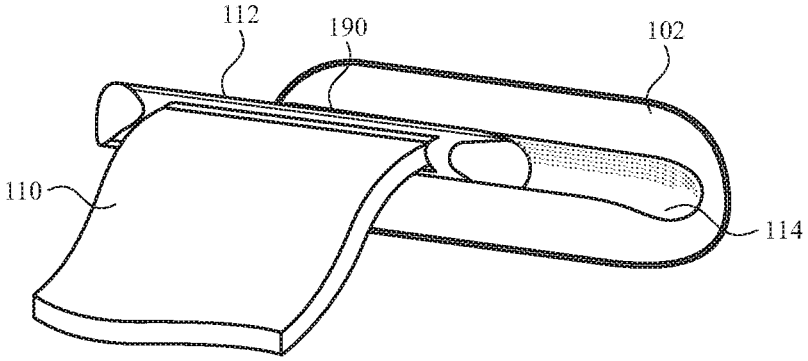
FIG. 7 illustrates a perspective view of the exemplary wearable device of FIG. 6, during insertion of the band into the electronic device.
Figure 8:
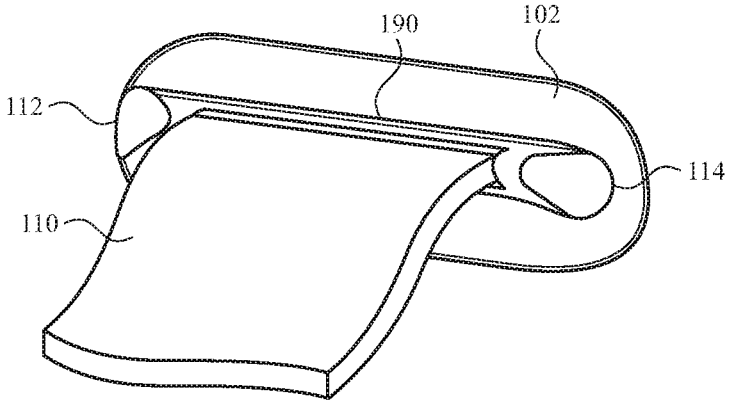
FIG. 8 illustrates a perspective view of the exemplary wearable device of FIG. 6, after insertion of the band into the electronic device.

While the identification element 190 is shown in FIG. 5 as being across from the electronic device 100, it will be recognized that the identification element 190 can located at other positions. For example, as shown in FIG. 6, one or both of the lugs 112 can include an identification element 190. The detector 170 of the electronic device 100 can be located at or near one or both of the channels 114 into which the lugs 112 are received. As shown in FIGS. 7 and 8, when a lug 112 is inserted into a channel 114, the identification element 190 is brought into alignment with and close proximity to the detector 170.

Referring now to FIGS. 6-8, the electronic device 100 can detect an identification element 190 of a band 110 by using a sensor that includes one or more detectors. In some embodiments, a sensor such as the detector 170 can be used to detect the identification element 190 when the band 110 is attached to the electronic device 100. The detector 170 include a magnetic field sensor and the identification element 190 can include one or more magnets. Where multiple magnets are included, the identification element 190 can include an arrangement of the magnets (e.g., different north-south orientations) that is distinct from the arrangement of another identification element 190 of a different band 110. The magnets can be arranged across the lug 112, such that insertion of the lug 112 into the channel 114 allows each of the magnets to pass across the detector 170. Such action can automatically activate sensing by the detector 170. The detector 170 can detect each of the magnets and determine an arrangement (e.g., north-south) thereof based on the magnetic fields of each magnet. The combined arrangement can have a distinct signature that is unique to the identification element 190. Thereby, the electronic device 100 can identify the band 110 and perform corresponding actions.

In some embodiments, the detector 170 can include one or more contact pins within the channel 114 for providing an electrically conductive pathway to the identification element 190. Multiple pins can be provided to conduct power, provide a connection to ground, and transmit signals. The pins of the detector 170 can retract within the channel 114 to accommodate passage of the lug 112.

In some embodiments, the detector 170 can optically sense the identification element 190 on the lug 112. A light source can be provided to facilitate optical sensing by the detector 170. The optical sensing can be conducted in manner similar to the operation of light source 122 and biosensor 124, discussed herein.

Figure 9:
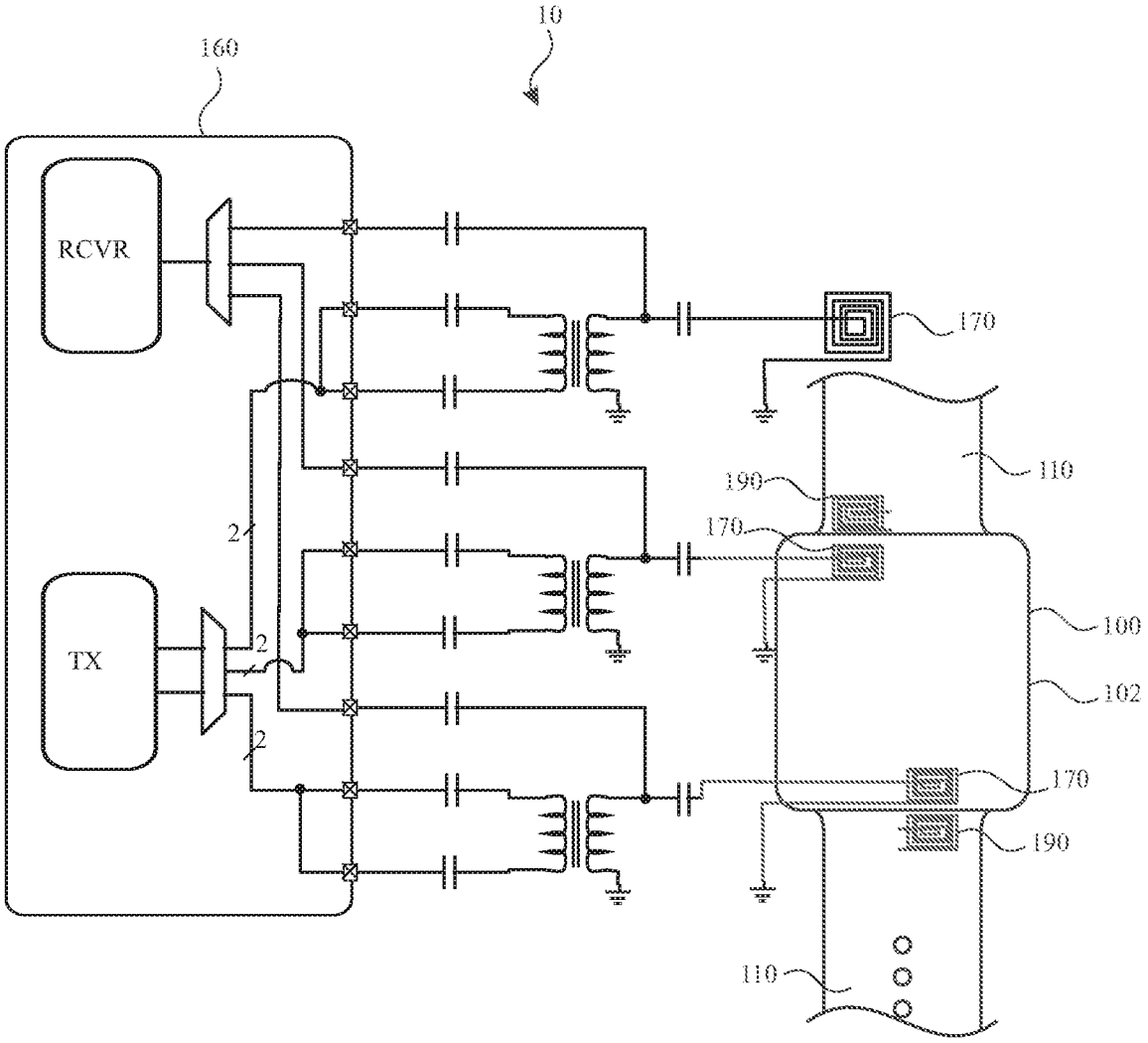
FIG. 9 illustrates a block system diagram of an exemplary wearable device.

Referring now to FIG. 9, one or more identification elements 190 can be provided at or near the ends of the band 110 and near the electronic device 100. The schematic diagram of FIG. 9, including a circuit diagram, represents components that are part of either the electronic device 100 or the band 110. While the components are shown outside the electronic device 100 for illustration purposes, it will be understood that these components (e.g., detectors 170 and communication element 160) can be within the housing 102 of the electronic device 100. The detectors 170 and/or the identification elements 190 can include one or more antennas (e.g., coils) for wireless communications there between.

As shown in FIG. 9, each identification element 190 can be positioned (e.g., at or near a lug 112) to be aligned with and in close proximity to a detector 170 (e.g., at or near a channel 114) of the electronic device 100 when the band 110 is connected to the electronic device 100. Where the band 110 has multiple (e.g., two) connections to the electronic device 100, a detector 170 can be provided near each connection so that each of the identification elements 190 is independently detected regardless of which connection is used. As such, separate identification elements 190 of separate bands 110 can be independently detected. It will be recognized that a single detector 170 can be used, for example to detect only one of the identification elements 190. Additionally or alternatively, a detector 170 can be provided other than at a location for attaching a band 110. For example, one or more detectors 170 can be provided for other purposes, as described further herein.

The system can be provided with low-power impedance detection circuitry to detect the presence of an identification element 190 near any one of the detectors 170. One or more additional detectors 170 can be positioned at other locations and used for other purposes (e.g., secure payment with NFC-enabled transmissions). Where multiple detectors 170 are used, an arrangement such the one shown in FIG. 9 can connect each of the detectors 170 to the same receiving and transmitting components of the communication element 160. Multiplexing techniques can be used to manage communications with each of the detectors 170. Furthermore, the detectors 170, which can optionally include an NFC radio, can also be used for other purposes. For example, external and/or internal switches and/or multiplexers can be provided for the multiplexing of more than one antenna to a transceiver. Detection of bands can be performed with at least some of the same components that provide communication with other devices, such as for data communication and/or financial transactions. It will be recognized that various arrangements can be provided to accomplish the multiple communication modes described herein. The detection can be contactless (e.g., non-conductive) so that the components can be protected from Galvanic corrosion that may occur in a contact-based arrangement. The detection can also be autonomous, such that user intervention or explicit operations are not required. Additionally, the detection can be performed without requiring the band 110 to provide its own power source. It will be recognized that a variety of other configurations are contemplated to provide wireless communication for detection of the identification element 190 of the band 110.

Figure 9A:
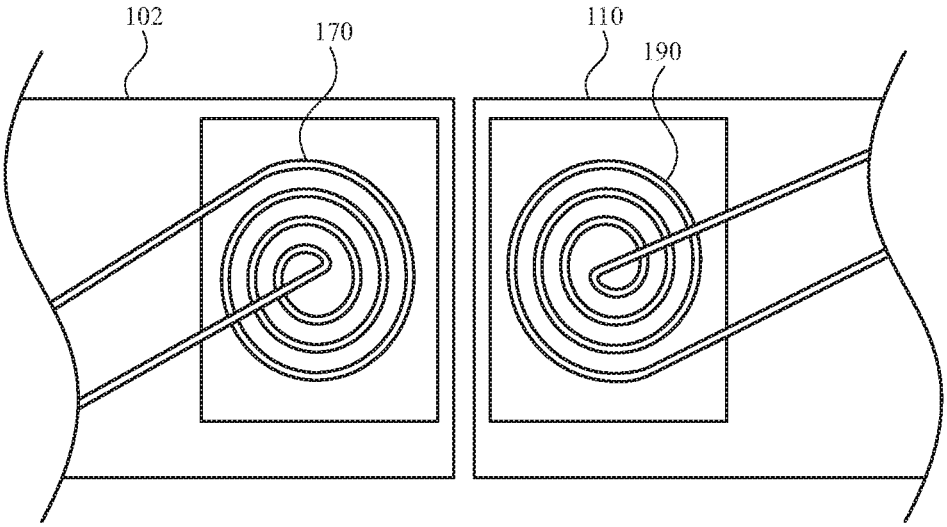
FIG. 9A illustrates a block system diagram of an exemplary wireless system.
Figure 9B:
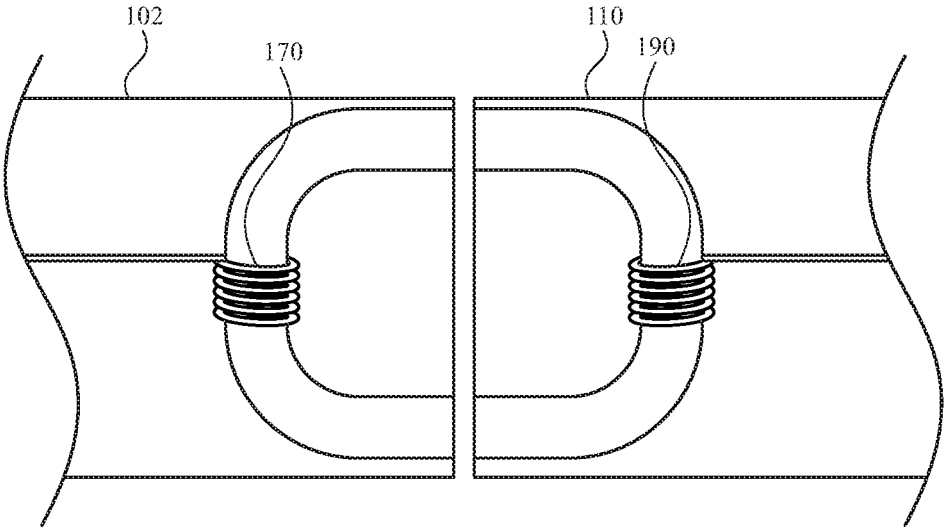
FIG. 9B illustrates a block system diagram of an exemplary wireless system.
Figure 9C:
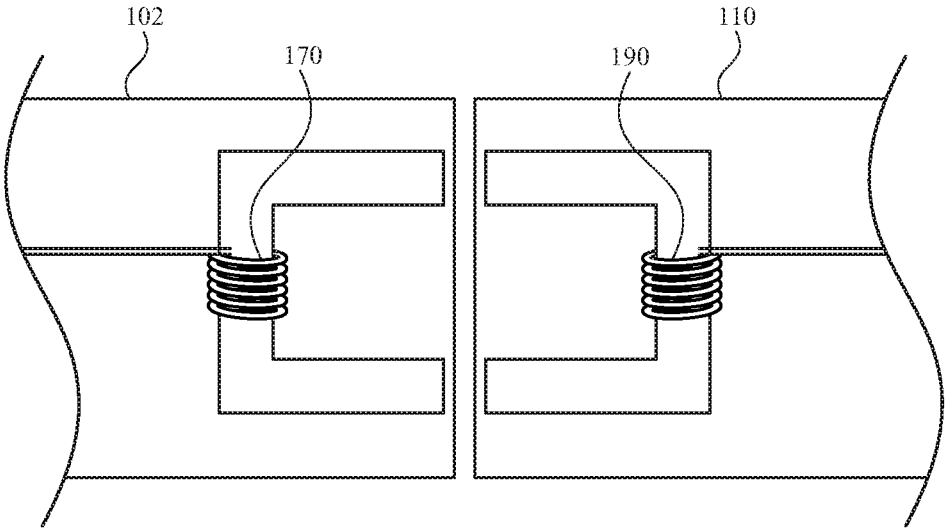
FIG. 9C illustrates a block system diagram of an exemplary wireless system.

Referring now to FIGS. 9A-9C, various antenna coil configurations are illustrated for a detector 170 and an identification element 190. As discussed above, a detector 170 and/or an identification element 190 can include one or more antennas. It will be recognized that the antennas can be a component of a system for wireless communication and power transfer between the housing 102 and the band 110. As shown in FIG. 9A, the detector 170 and/or the identification element 190 can each include a flexible circuit forming a printed coil. The printed circuits can be formed in a contour of the housing and/or the lug of the band to provide sufficient magnetic coupling to transfer power and data. As shown in FIG. 9B, the detector 170 and/or the identification element 190 can each form a transformer that includes a coil wound about a core. The coil windings can each form a portion (e.g., half) of a toroid. It will be recognized that other transformer arrangements are contemplated. For example, As shown in FIG. 9C, a transformer can include coils wound about a bar of magnetic material. Other geometries for the coils and core are contemplated.

Figure 10:
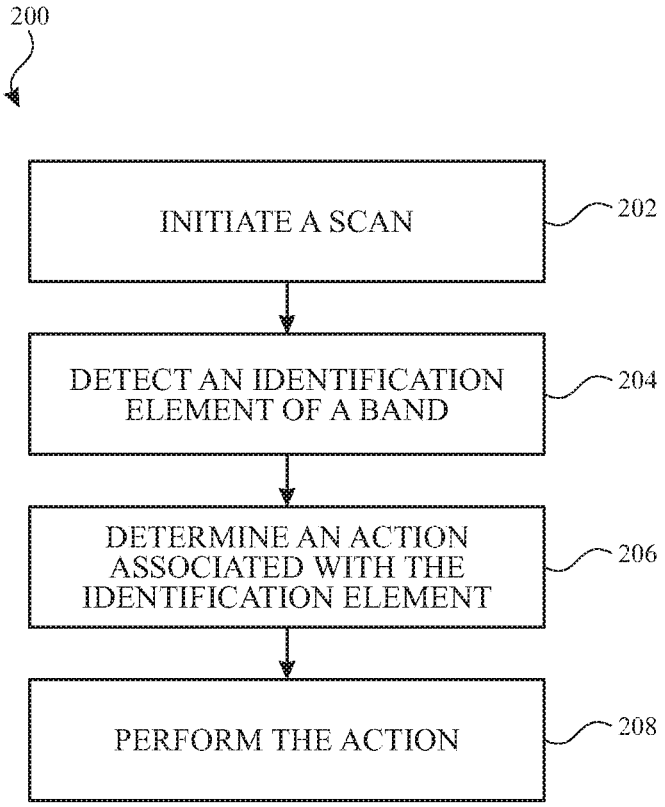
FIG. 10 illustrates a flow chart of an exemplary process.

Referring now to FIG. 10, a method 200 can be performed by an electronic device 100 to interact with a band 110. In an operation 202, the electronic device 100 can initiate a scan for an identification element. The electronic device 100 can be placed into a scanning mode based on manual and/or automated initiation. For example, the user can place the electronic device 100 into a scanning mode by providing manual inputs to the electronic device 100. For at least a limited period of time thereafter, the electronic device 100 can activate its components to scan for the identification element 190 of a band 110. Alternatively or additionally, the electronic device 100 can automatically activate its components after it senses the presence of an identification element 190, for example as described above. Additionally or alternatively, the electronic device can initiate a scan for an identification element upon detection that the electronic device is worn by a user. For example, when the electronic device detects that it is being worn (e.g., based on proximity to a user as can be sensed by the PPG sensor) after a period of not being worn, the electronic device can initiate a scan to detect the identification element of any band present. By further example, the electronic device can detect the presence of a band based on sensed changes, such as a change in impedance or inductance of a coil when the band is inserted into the electronic device. Such changes can be used to initiate a scan. Additionally or alternatively, the electronic device can initiate scans periodically or based on a predetermined schedule.

In an operation 204, the electronic device 100 can detect an identification element 190 of a band 110. Exemplary components and mechanisms for detecting the identification element 190 are described above. One of more of these components and/or mechanisms can be applied to effectively detect the identification element 190. Once the identification element 190 has been detected, a record thereof can be stored within a memory 152 of the electronic device 100. The identification element 190 can be an indicator of a feature of the band 110. For example, the identification element 190 can indicate a type, model, color, size, or other characteristic of the band 110. Where the identification element 190 indicates one characteristic (e.g., model) of the band 110, other characteristics (e.g., color, size) can be inferred.

The identification can serve as an input to determine an action to be performed by the electronic device 100. In an operation 206, the electronic device 100 can determine an action associated with the identification element 190. Each of a variety of identification elements 190 corresponding to different bands 110 can be recorded in the memory 152 of the electronic device 100. Each of the recorded identification elements 190 can have associated therewith a corresponding action. The record of identification elements 190 and associated actions can be in the form of a table, array, or other data structure. When a given identification element 190 is detected, it can be compared with the recorded identification elements 190 to find a match and determine the corresponding action. While the foregoing discussion relates to referencing memory 152 onboard the electronic device 100, it will be recognized that the electronic device 100 can reference another database apart from the electronic device 100. The association of identification elements 190 and corresponding actions can be preprogrammed, user-selected, or a result of machine-learning based on prior usage with one or more bands 110.

In an operation 208, the electronic device 100 can perform the action that has been determined to be associated with the identification element 190. For example, the recorded action corresponding to the detected identification element 190 can include instructions for execution by the processor 150 and/or other components of the electronic device 100. Alternatively or additionally, the action can include causing another device, apart from the electronic device 100, to execute instructions. The action can be performed automatically upon identification of a band 110. Additionally or alternatively, the electronic device 100 can provide a prompt requesting user confirmation of the action, and the action can be performed after user confirmation is received. Additionally or alternatively, a user can manually override or modify the action.

Various exemplary actions are discussed below. Actions performed by the electronic device 100 in response to detection of an identification element 190 include influencing regular operation of the electronic device 100. For example, the regular operation of the electronic device 100 can be maintained with additional or altered features based on the selected band 110. As such, the user's experience with the electronic device 100 during its regular operation is enhanced.

In some embodiments, upon identifying a particular band 110, the electronic device 100 provides a feature of a visual user interface that corresponds to a characteristic of the band 110. For example, the electronic device 100 can display on the display 104 a feature that is substantially the same color as the band 110. Alternatively or additionally, the feature can be a similar color, a matching color, or a complementary color. The feature can be any visible feature of the display 104. Exemplary features include watchhands, text, numbers, symbols, graphics, charts, markers, or any displayed item. One, some, or all of the features visible on the display 104 can be altered based on the color of the identified band 110. By further example, the electronic device 100 can display on the display 104 a feature that is associated with the band 110, regardless of color selection. For example, displayed information, watch faces, menu items, and selectable icons can be selected based on the selection of band 110.

In some embodiments, upon identifying a particular band 110, other settings of the electronic device 100 can be modified. A band 110 can be associated with an activity that is supported by the electronic device 100. For example, an exercise band can be worn when a user is exercising. Upon identification of the exercise band, actions conducive to an exercise session can be performed by the electronic device 100. For example, the electronic device 100 can display particular information, track activity of the user, take a biometric reading, record a location of the user, launch an activity tracking app, and/or modify notifications settings (e.g., to be more prominent). By further example, a formal band can be worn in a more formal setting. Upon identification of the formal band, actions conducive to a formal setting can be performed by the electronic device 100. For example, the electronic device 100 can display particular information, modify notifications settings (e.g., to be less prominent), provide reminders to the user, and/or record a location of the user.

Actions performed by the electronic device 100 in response to detection of an identification element 190 include actions outside of the regular operation of the electronic device 100. For example, the electronic device 100 can perform actions that are only available when a particular band 110 is detected. As such, the user's experience with the electronic device 100 is expanded with the selection of bands 110.

Figure 11:
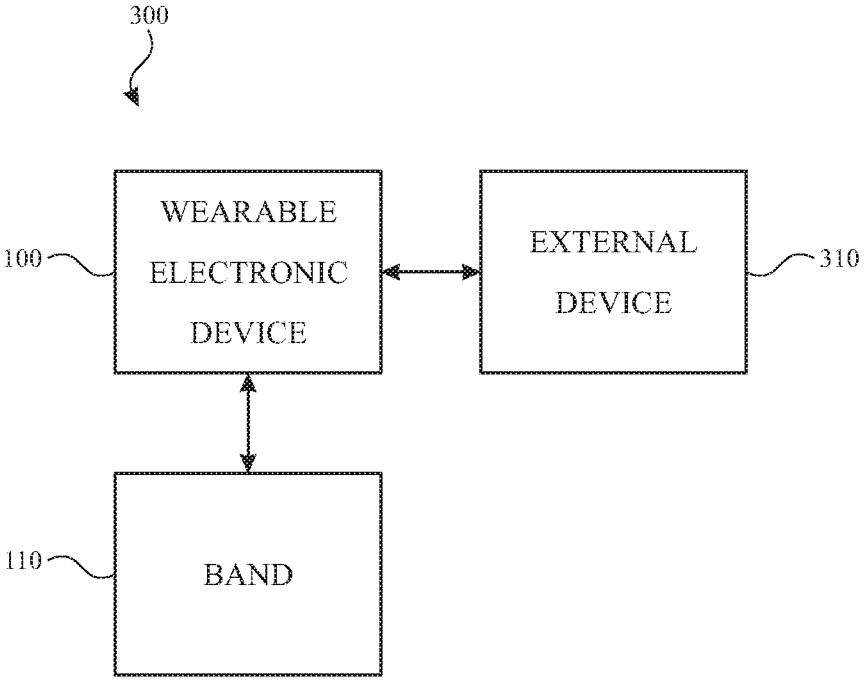
FIG. 11 illustrates a block diagram of an exemplary system.

In some embodiments, a band 110 can include an identification element 190 that provides authorization for otherwise unavailable actions. For example, a band 110 can facilitate redemption of items of value. The band 110 can be used with the electronic device 100 to redeem items of value, such as credit, gift cards, funds, cash, prizes, digital media, access to content (e.g., online content), goods, and/or services. The identification element 190 can provide information to the electronic device 100 for authorizing redemption of an item of value. For example, the identification element 190 can include a code that is verifiable by an external device. As shown in FIG. 11, a system 300 can manage the redemption. The electronic device 100 can identify a band 110 and communicate with an external device 310. Information from the identification element 190 can be transmitted from the electronic device 100 to the external device 310. The external device 310 can verify the information and authorize redemption of an item of value. The external device 310 can further manage the redemption by executing a transfer to an account associated with the electronic device 100. Bands 110 that facilitate redemption of items of value can be provided by vendors, retailers, service providers, or entities that manage the redemption process. The bands 110 can be provided, exchanged, and transferred for sale or as gifts based on the value of the redeemable items. The bands 110 can be provided as promotional items in conjunction with an event. For example, bands 110 can be provided at a festival, convention, conference, concert, or reunion, to provide attendees possessing the bands 110 with access items of value that are associated with the event. Each attendee can access the items of value by using the bands 110 with their respective electronic devices 100.

In some embodiments, a band 110 and an electronic device 100 can interact and operate in a manner that is not necessarily perceivable by a user. For example, an electronic device 100 can track usage of one or more bands 110. The tracked usage information includes dates, times, durations, locations, activities, biometrics of the user, and/or environmental features in relation to periods before, during, and/or after usage of each band 110. The tracked usage information can be collected during a background process of the electronic device 100. The tracked usage information can be output to a user or uploaded to an external device for analysis. The tracked usage information can be used for machine learning in relation to how each band 110 is used.

The electronic device 100 can perform a variety of other actions upon identification of a band 110. It will be recognized that the detection of an identification element 190 can be followed by any associated action that can be performed by the electronic device 100. For example, where the electronic device 100 has the required capabilities, the electronic device 100 launches an app, opens a website, starts a timer, displays a message, provides an alert, communicates with another device, and/or other functions.

To illustrate the interchangeability of hardware and software, items such as the various illustrative blocks, modules, components, methods, operations, instructions, and algorithms have been described generally in terms of their functionality. Whether such functionality is implemented as hardware, software or a combination of hardware and software depends upon the particular application and design constraints imposed on the overall system. Skilled artisans may implement the described functionality in varying ways for each particular application.

A reference to an element in the singular is not intended to mean one and only one unless specifically so stated, but rather one or more. For example, "a" module may refer to one or more modules. An element proceeded by "a," "an," "the," or "said" does not, without further constraints, preclude the existence of additional same elements.

Headings and subheadings, if any, are used for convenience only and do not limit the invention. The word exemplary is used to mean serving as an example or illustration. To the extent that the term include, have, or the like is used, such term is intended to be inclusive in a manner similar to the term comprise as comprise is interpreted when employed as a transitional word in a claim. Relational terms such as first and second and the like may be used to distinguish one entity or action from another without necessarily requiring or implying any actual such relationship or order between such entities or actions.

Phrases such as an aspect, the aspect, another aspect, some aspects, one or more aspects, an implementation, the implementation, another implementation, some implementations, one or more implementations, an embodiment, the embodiment, another embodiment, some embodiments, one or more embodiments, a configuration, the configuration, another configuration, some configurations, one or more configurations, the subject technology, the disclosure, the present disclosure, other variations thereof and alike are for convenience and do not imply that a disclosure relating to such phrase(s) is essential to the subject technology or that such disclosure applies to all configurations of the subject technology. A disclosure relating to such phrase(s) may apply to all configurations, or one or more configurations. A disclosure relating to such phrase(s) may provide one or more examples. A phrase such as an aspect or some aspects may refer to one or more aspects and vice versa, and this applies similarly to other foregoing phrases.

A phrase "at least one of" preceding a series of items, with the terms "and" or "or" to separate any of the items, modifies the list as a whole, rather than each member of the list. The phrase "at least one of" does not require selection of at least one item; rather, the phrase allows a meaning that includes at least one of any one of the items, and/or at least one of any combination of the items, and/or at least one of each of the items. By way of example, each of the phrases "at least one of A, B, and C" or "at least one of A, B, or C" refers to only A, only B, or only C; any combination of A, B, and C; and/or at least one of each of A, B, and C.

It is understood that the specific order or hierarchy of steps, operations, or processes disclosed is an illustration of exemplary approaches. Unless explicitly stated otherwise, it is understood that the specific order or hierarchy of steps, operations, or processes may be performed in different order. Some of the steps, operations, or processes may be performed simultaneously. The accompanying method claims, if any, present elements of the various steps, operations or processes in a sample order, and are not meant to be limited to the specific order or hierarchy presented. These may be performed in serial, linearly, in parallel or in different order. It should be understood that the described instructions, operations, and systems can generally be integrated together in a single software/hardware product or packaged into multiple software/hardware products.

In one aspect, a term coupled or the like may refer to being directly coupled. In another aspect, a term coupled or the like may refer to being indirectly coupled.

Terms such as top, bottom, front, rear, side, horizontal, vertical, and the like refer to an arbitrary frame of reference, rather than to the ordinary gravitational frame of reference. Thus, such a term may extend upwardly, downwardly, diagonally, or horizontally in a gravitational frame of reference.

The disclosure is provided to enable any person skilled in the art to practice the various aspects described herein. In some instances, well-known structures and components are shown in block diagram form in order to avoid obscuring the concepts of the subject technology. The disclosure provides various examples of the subject technology, and the subject technology is not limited to these examples. Various modifications to these aspects will be readily apparent to those skilled in the art, and the principles described herein may be applied to other aspects.

All structural and functional equivalents to the elements of the various aspects described throughout the disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or, in the case of a method claim, the element is recited using the phrase "step for".

The title, background, brief description of the drawings, abstract, and drawings are hereby incorporated into the disclosure and are provided as illustrative examples of the disclosure, not as restrictive descriptions. It is submitted with the understanding that they will not be used to limit the scope or meaning of the claims. In addition, in the detailed description, it can be seen that the description provides illustrative examples and the various features are grouped together in various implementations for the purpose of streamlining the disclosure. The method of disclosure is not to be interpreted as reflecting an intention that the claimed subject matter requires more features than are expressly recited in each claim. Rather, as the claims reflect, inventive subject matter lies in less than all features of a single disclosed configuration or operation. The claims are hereby incorporated into the detailed description, with each claim standing on its own as a separately claimed subject matter.

The claims are not intended to be limited to the aspects described herein, but are to be accorded the full scope consistent with the language claims and to encompass all legal equivalents. Notwithstanding, none of the claims are intended to embrace subject matter that fails to satisfy the requirements of the applicable patent law, nor should they be interpreted in such a way.

What is claimed is:

1. A wearable device comprising:

an electronic device comprising:

a processor; and a sensor; and a band that is attachable to the electronic device for securing the electronic device to a user;

wherein the band includes an identification element corresponding to a characteristic of the band, and wherein the processor is operably connected to the sensor and configured to detect the identification element with the sensor and determine whether to execute an action based on the detected identification element;

wherein the sensor is configured to measure a health metric of the user, wherein the sensor comprises:

a light emitting device for emitting light, wherein the identification element reflects the light from the light emitting device; and a photodetector for capturing the light reflected from the identification element;

wherein the electronic device further comprises a display, wherein the characteristic of the band is a color of the band, and wherein the action based on the detected identification element is changing a feature on the display.

2. The wearable device of claim 1, wherein the feature is changed to include the color.

3. The wearable device of claim 1, wherein the sensor is a photoplethysmography sensor.

4. The wearable device of claim 1, wherein the identification element is a marking on a surface of the band, and the marking reflects light that is outside the visible spectrum.

5. A method comprising:

detecting, with a sensor of an electronic device, an identification element of a band for securing the electronic device to a user, wherein the identification element indicates a characteristic of the band, the characteristic comprising a color of the band, the detecting comprising:

emitting light from a light emitting device of the electronic device, wherein the identification element reflects the light from the light emitting device; and capturing the light reflected from the identification element with a photodetector;

determining whether to perform an action associated with the identification element; and executing, with the electronic device, the action comprising changing a feature on a display of the electronic device.

6. The method of claim 5, wherein determining the action associated with the identification element comprises:

transmitting, from the electronic device, the identification element to an external device; and receiving, at the electronic device, the action from the external device.

7. The method of claim 5, further comprising:

transmitting, from the electronic device, the identification element to an external device; and receiving, at the electronic device, an authorization from the external device, wherein executing the action is after receiving the authorization.

8. The method of claim 5, wherein executing the action further comprises changing a setting of the electronic device.

9. The method of claim 5, wherein executing the action further comprises launching an application from a memory of the electronic device.

10. The method of claim 5, wherein the feature is changed to include the color.

11. A watch comprising:

an electronic device comprising:

a housing;

a display;

a processor within the housing; and a sensor comprising a light emitting device for emitting light and a photodetector for capturing light; and a band that is attachable to the housing of the electronic device for securing the electronic device to a user, wherein the band includes an identification element corresponding to a color of the band;

wherein the processor is operably connected to the sensor and configured to detect the identification element with the light emitted from the light emitting device and reflected from the identification element to the photodetector, the processor being configured to determine whether to execute an action based on the detected identification element, the action comprising changing a feature on the display.

12. The watch of claim 11, wherein the feature is changeable to include the color.

13. The watch of claim 11, wherein the sensor is a photoplethysmography sensor.

14. The watch of claim 11, wherein the identification element is a marking on a surface of the band, and the marking reflects light that is outside the visible spectrum.

15. The watch of claim 11, wherein the housing further comprises a channel for receiving a lug of the hand, the identification element is positioned at the lug of the hand, and the sensor is arranged to detect the identification element when the lug of the band is received into the channel.

* * * * *